United States Patent [19]

Dahlberg

[11] 3,960,318

[45] June 1, 1976

[54] CENTRIFUGAL SEPARATOR

[75] Inventor: Bengt Ingmar Dahlberg, Uttran, Sweden

[73] Assignee: Alfa-Laval AB, Tumba, Sweden

[22] Filed: Sept. 30, 1974

[21] Appl. No.: 510,469

[30] Foreign Application Priority Data

Oct. 1, 1973 Sweden ..... 7313303

[52] U.S. Cl. ..... 233/4; 233/7; 233/14 R; 233/21; 233/46

[51] Int. Cl.[2] ..... B04B 7/04; B04B 11/02

[58] Field of Search ..... 233/14 R, 14 A, 7, 21, 233/27, 46, 1 D, 3, 4

[56] References Cited

UNITED STATES PATENTS 2,528,974 11/1950 Ritsch ..... 233/14 X 3,730,769 5/1973 Fiedler ..... 233/46

FOREIGN PATENTS OR APPLICATIONS 1,026,692 3/1958 Germany ..... 233/14 R

*Primary Examiner*—George H. Krizmanich

*Attorney, Agent, or Firm*—Cyrus S. Hapgood

[57] ABSTRACT

The solids separated from a liquid in a centrifugal rotor are discharged through outlets of the rotor into a stationary chute surrounding the rotor and into which a flushing liquid is supplied. The chute is provided with an overflow outlet which coacts with the supply means for the flushing liquid to provide in the chute a layer of liquid of a thickness determined by the overflow outlet and rotating around the rotor, the discharged solids being received by and dispersed in this rotating layer and departing together with liquid over the overflow outlet.

2 Claims, 1 Drawing Figure

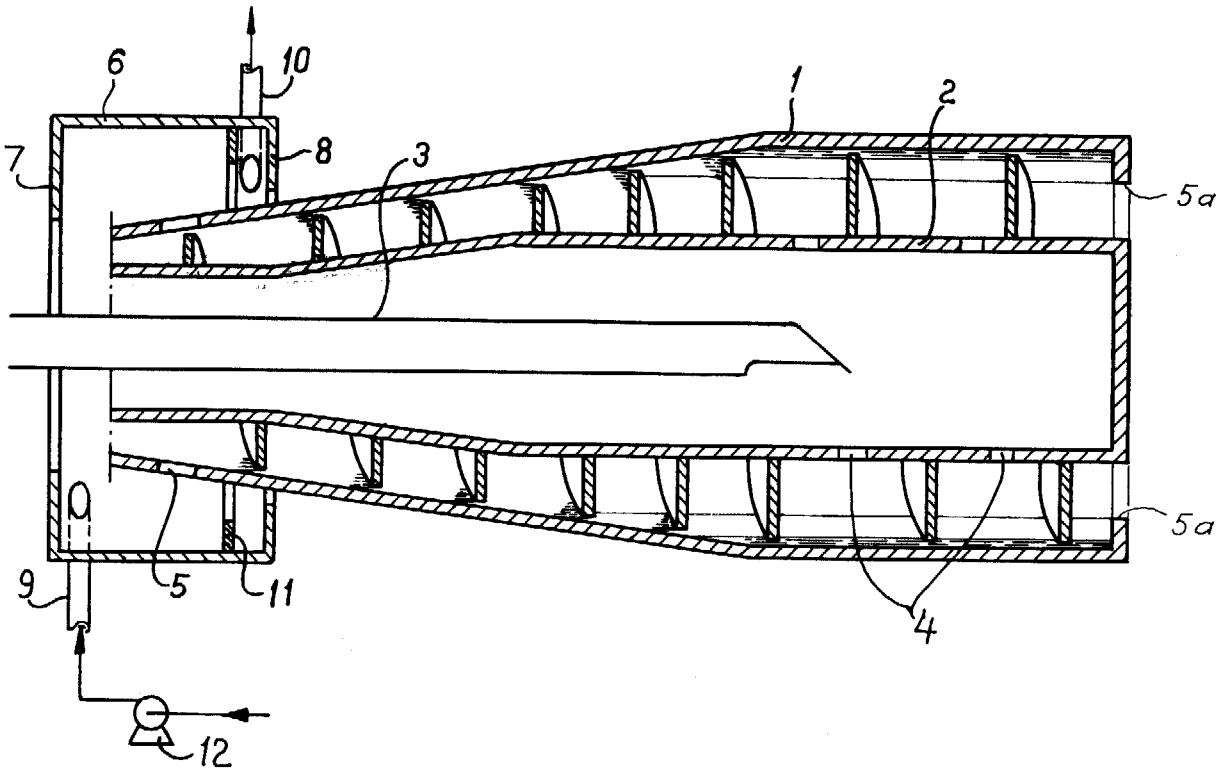
5a
5a
2
4
1
3
8
10
11
12
5
6
7
9

CENTRIFUGAL SEPARATOR

The present invention relates to an arrangement in a centrifugal separator of the type comprising a rotor with outlets for discharging separated solids during operation, a stationary chute extending around the rotor in front of these outlets for receiving and conveying the discharged solids, and means for supplying flushing liquid to the chute, whereby the solids are conveyed along the chute to an outlet therefrom.

In refining processes, such as that used in the production of starch, solids discharged from a centrifugal separator are often to be diluted with water and conveyed to a subsequent step of treatment in the process. This usualy takes place in such manner that the solids are caught in a so-called reception cover of the centrifugal separator and are flushed away by means of water to a pump, for example.

Although special nozzles have been used, it has proved impossible to keep the reception cover clean from deposits. The solids tend to deposit in the reception cover and form clots which suddenly loosen and sometimes cause clogging of the pump, resulting in an interruption of the operation. In addition, the feeding of solids to the subsequent step of treatment becomes uneven, which in many cases is objectionable.

The principal object of the present invention is to eliminate the above-noted disadvantages and to provide an arrangement whereby all the solids discharged from the centrifuge rotor are effectively dispersed in the liquid which is supplied to the reception cover and which is then to be passed to the subsequent step of treatment in the process.

The arrangement according to the invention is characterized in that the aforementioned chute has an overflow outlet which enables a layer of liquid, of a thickness determined by the overflow outlet and rotating around the rotor, to be formed in the chute for receiving the discharged solids, the aforementioned means for supplying flushing liquid being adapted to supply such an amount of liquid to the chute that the solids are dispersed therein and depart together with the liquid over the overflow outlet.

By means of such an arrangement, the reception cover can be kept clean of deposits, and any clotted solids can be carried by the rotating liquid layer in the chute until they have been broken and the solids have been dispersed essentially completely in the flushing liquid.

If the chute is disposed close enough to the centrifuge rotor, whereby the latter essentially bridges the gap between the side walls of the chute, the rotating liquid layer can be created in the chute owing to the fact that the flushing liquid is carried by the strong air currents occurring in the vicinity of the centrifuge rotor when rotating. In such a case it is not necessary to introduce the flushing liquid into the chute in any particular manner. According to a preferred embodiment of the invention, however, flushing liquid is supplied to the chute in the longitudinal direction thereof, whereby the rotation of the liquid layer in the chute is assisted or possibly completely created by this introduction.

The invention will be described in further detail below with reference to the accompanying drawing. In the drawing, the single illustration is a longitudinal sectional view of a centrifugal separator of the type having a worm for discharging separated solids and which also has an arrangement according to the invention for receiving the discharged ooze.

The centrifugal separator as illustrated comprises a centrifugal rotor 1 in which a worm conveyor 2 is provided. The rotor 1 and the worm 2 are arranged to be rotated about a common horizontal axis in the same direction but with differing velocities, in a manner well known in the art. A mixture of liquid and solids is intended to flow from an inlet tube 3 through openings 4 in the worm 2 and out into the rotor 1. The rotor has outlet openings 5 for separated solids at one of its ends (its tapered end) and overflow openings 5a for separated liquid at its opposite end.

According to the invention, the arrangement for receiving the solids discharged through the outlet openings 5 comprises a stationary, cylindrical housing 6 having annular end walls 7 and 8. The housing 6 surrounds the tapered end portion of the rotor, whereby the outlet openings 5 discharge into the housing 6. The housing 6 has a tangentially extending inlet 9 for liquid, and axially spaced therefrom is an outlet 10 which also extends tangentially. Located axially between the inlet 9 and the outlet 10, within the housing 6, is an annular partition wall 11 having less radial extension than the end walls 7 and 8. A pump 12 is provided for pumping liquid through the inlet 9 into the housing 6.

During operation of the centrifugal separator, liquid such as water is delivered with a suitable pressure through the inlet 9, whereby a radially rotating liquid layer is formed in the housing 6 between the end wall 7 and the partition wall 11. The thickness of the liquid layer is determined by the radial extension of the partition wall 11. Liquid flowing over the partition wall 11 is passed out through the outlet 10.

The solids discharged through the openings 5 in the rotor 1, which may consist of starch, are received by the rotating liquid layer and dispersed therein. The dispersion thus formed then discharges, due to its rotational energy, through the tangential outlet 10. The liquid inlet 9 is preferably arranged so that the liquid layer in the housing 6 is caused to rotate in the same direction as the rotor 1, whereby the kinetic energy of the discharged solids will contribute to the rotation of the liquid layer. Owing to the rapid rotation of the liquid layer, depositing of solids in the housing 6 is prevented. Any clotted solids will be caused to rotate together with the liquid layer and to remain therein due to centrifugal force until they have shattered and the solids have been dispersed generally completely in the liquid, so that they can depart over the partition wall 11.

In case a particularly heavy liquid current through the housing 6 should be necessary without introducing a corresponding amount of flushing liquid, a portion of the dispersion discharged through the outlet 10 can be returned to the inlet 9.

The arrangement according to the invention can be used even when it is desired that the solids discharged from the centrifuge rotor should be mixed with as little flushing liquid as possible. If the arrangement is applied, for example, to a centrifugal separator of the type in which solids are intermittently discharged from its rotor, either the feed of flushing liquid could be interrupted between the discharge occasions or flushing liquid departing from the outlet 10 could be conveyed to some place other than the place of reception of separated solids. Blades (not shown) can be fastened to the rotor 1 in order to assist in rotating the liquid layer in the housing 6.

I claim:

1. A centrifugal separator comprising a rotor for receiving a mixture of liquid and solids and having outlets for discharging separated solids during operation of the rotor, a stationary chute extending around the rotor and positioned in front of said outlets to receive and convey the discharged solids, means for supplying flushing liquid to the chute, and means forming an overflow outlet of the chute and coacting with said supply means to provide in the chute a layer of liquid of a thickness determined by said overflow outlet and rotating around said rotor, said supply means being operable to supply liquid to the chute in an amount sufficient to cause said discharged solids to be dispersed in the liquid and to depart together with the liquid over said overflow outlet, said chute being formed by a cylindrical housing having annular end walls, the housing also having an annular partition wall located between said end walls and having less radial extension than one of said end walls, the chute being located between said one end wall and the annular partition wall, the housing having an outlet between said partition wall and the other end wall.

2. The separator of claim 1, in which said outlet extends generally tangentially from said housing.

* * * * *